US006548774B1

(12) United States Patent
Bachle

(10) Patent No.: US 6,548,774 B1
(45) Date of Patent: Apr. 15, 2003

(54) DEVICE FOR SWITCHING AN ELECTRIC CONNECTION, ESPECIALLY IN A HINGE SWITCH

(75) Inventor: Erik Bachle, Filderstadt (DE)

(73) Assignee: Euchner GmbH Co., Leinfelden-Echterdingen (DE)

( * ) Notice: Subject to any disclaimer, the term of this patent is extended or adjusted under 35 U.S.C. 154(b) by 0 days.

(21) Appl. No.: 09/869,857

(22) PCT Filed: Jan. 22, 2000

(86) PCT No.: PCT/EP00/00482

§ 371 (c)(1),
(2), (4) Date: Jul. 6, 2001

(87) PCT Pub. No.: WO00/45401

PCT Pub. Date: Aug. 3, 2000

(30) Foreign Application Priority Data

Jan. 26, 1999 (DE) ..... 199 02 919

(51) Int. Cl.[7] ..... H01H 3/16
(52) U.S. Cl. ..... 200/61.7
(58) Field of Search ..... 200/61.7, 19.03, 200/19.13, 19.2, 243, 573–574

(56) References Cited

U.S. PATENT DOCUMENTS 4,049,934 A 9/1977 Newlon
4,100,581 A * 7/1978 Slack et al. ..... 200/61.62
4,922,064 A 5/1990 Price et al.
5,075,517 A * 12/1991 Spanio ..... 200/16 A
6,255,605 B1 * 7/2001 Leiter et al. ..... 200/19.2

FOREIGN PATENT DOCUMENTS

| | | |
|---|---|---|
| EP | 0 304 241 | 2/1989 |
| GB | 2 150 757 A | 7/1985 |
| WO | 93/24946 | 12/1993 |

* cited by examiner

*Primary Examiner*—Elvin Enad
*Assistant Examiner*—M. Fishman
(74) *Attorney, Agent, or Firm*—Roylance, Abrams, Berdo & Goodman, L.L.P.

(57) ABSTRACT

A device for switching an electric connection, especially a hinge switch includes a pin that can be actuated form outside the device. The device further includes an actuator arranged on the pin and interacting with a switch that switches the electric connection once a switching point is exceeded. The device allows the switching point to be adjusted and readjusted simply and permanently with relatively few constructive elements. The actuator is displaced in a radial and/or an axial direction in relation to the pin by an adjusting device in such a manner that the switching point can be adjusted to a given angel position of the pin.

16 Claims, 2 Drawing Sheets

DEVICE FOR SWITCHING AN ELECTRIC CONNECTION, ESPECIALLY IN A HINGE SWITCH

Figure 1:
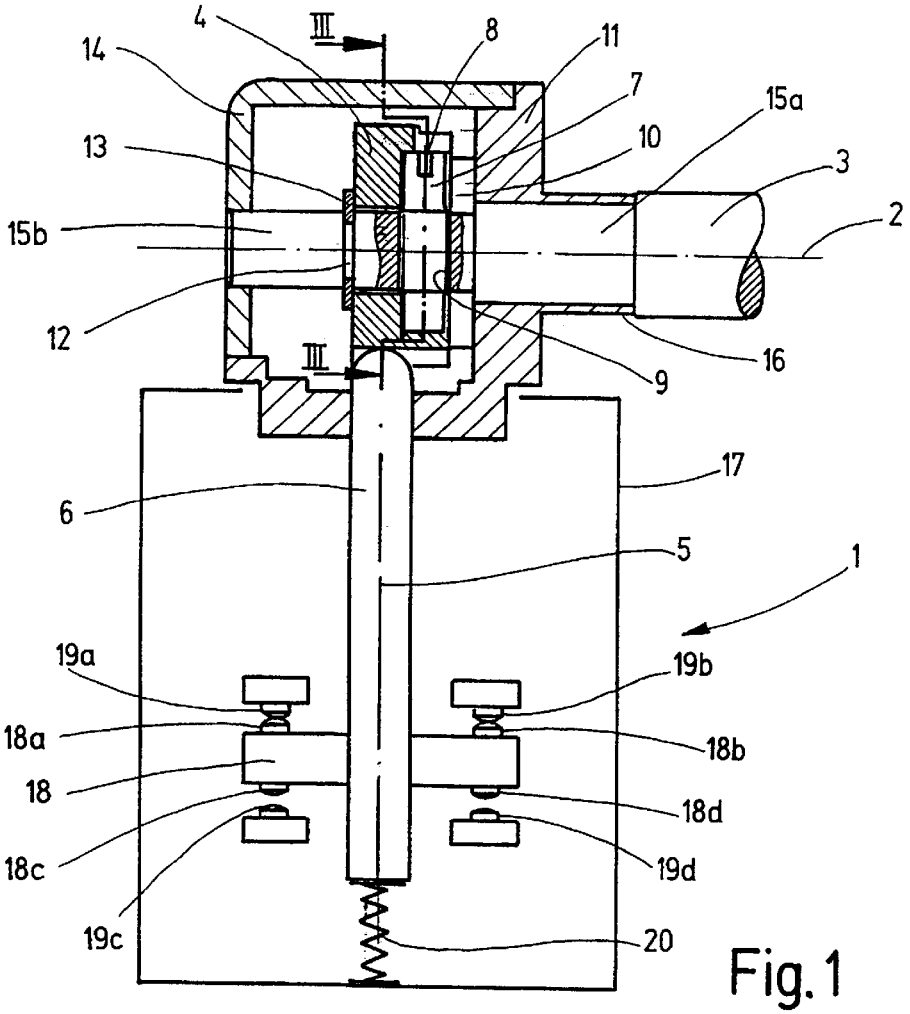

The invention relates to a device for switching an electric connection, especially a hinge switch, as described in the disclosure part of claim 1.

A device of this sort is already known from WO 93/24946. On the pin which is actuated from outside the device is arranged a multiple-component cam plate serving as actuating means, on the peripheral surface of which engages a switching device in the form of a switch tappet which switches the electric connection when a certain switching point has been exceeded. All of the three parts of the cam plate are arranged and affixed relative to one another in the direction of rotation of the pin during assembly of the device. By switching the contact surfaces associated with the parts, they define the position and the dimensional extension of a switching notch or groove for the tappet on the peripheral surface of the cam plate.

The multiple-component cam plate used in the known device requires a high outlay for manufacture, and particularly for the assembly of such devices. Adjustment of the switching point following the assembly is not possible, and moreover the device must be completely disassembled for a new setting of the switching point for which several fixing screws must be released, which following the new setting adjustment must be screwed back in again.

DE-AS 10 91 187 discloses a rotary switch with cam disks which in turn are secured removably on the switch pin by means of a fastening screw. The fastening screw used for this purpose can be inserted in a passage passing all the way through the switch pin and can be screwed into a threaded bore of the cam disk. In this case, the position of the cam disk in relation to the switch pin is adjustable neither in radial nor axial direction nor in peripheral direction.

DE-OS 21 45 115 discloses a rocking lever switch having a snap-switch device. The switching means or the tappet is made up of an actuator sheathing and a switching pin which can be screwed together, whereupon the effective length of the tappet and thus of the switching point can be adjusted.

U.S. Pat. No. 403,169 discloses a cam having a different type of mechanical control device. A bushing element which can be connected with a pin can be detachably secured at several discrete positions on the cam. The discrete positions are predetermined invariably by cooperating gearing arranged both on the bushing element and on the cam plate.

The object of the present invention is to provide a device as described in the disclosure part of claim 1 which will guarantee a simple and permanent precision setting and adjustment of the switching point using relatively few constructive elements.

The problem is solved by means of the device claimed in claim 1. Particular different embodiments of the invention are disclosed in the dependent claims.

With the solution of the problem according to claim 1 the switching of the electric connection involves the opening and/or closing of at least one pair of contacts. The pin can be configured either as pivotal only back and forth or else can be configured to rotate, making complete revolutions. The switching means can be mounted on the actuating means and displaced in radial or axial direction on the actuating means in relation to the pin. The simple radial and/or axial displacement of the actuating means to be undertaken simply in relation to the pin guarantees the capacity to perform a permanent and precise adjustment and readjustment of the switching point. For certain types of uses the traditional switching point is arranged at a rotation of the pin of approximately 3 degrees. Preferably the switching means has a longitudinal axis which with the pin forms an angle of 90 degrees. Preferably the longitudinal axis of the switching device and the longitudinal axis of the pin intersect. The actuating means is preferably configured of one single piece. The adjustment means is preferably arranged in threaded, clamped or catch connection with the pin.

The particular type of embodiment disclosed in claim 2 offers the advantage that by simple rotation of the headless screw the position of the actuating means can be modified in relation to the pin and thus the switching point can be adjusted simply and precisely. Therefore, because of its stationary arrangement in relation to the actuating means, the headless screw serves as part of the interlocking gearing of the rotary movement of the pin on the actuating means. Particularly, with this arrangement, additional secure fixing of the actuating means on the pin with regard to its rotary movement can be relinquished. These headless screws are frequently also indicated as setscrews.

The particular embodiment according to claim 3 has the advantage that with headless screw screwed into the pin the actuating means can be displaced by inward thrust or can be simply inserted into the pin for example during the assembly of the device, whereby the headless screw can be inserted into the mounting opening at least partially form-locking. Preferably the headless screw has a threadless, journal-like segment at each of its ends, which can be inserted into the corresponding mounting.

The particular type of embodiment of claim 4 has the advantage that the actuating means is affixed simply and reliably in its axial position on the pin. Insofar as the actuating means can be screwed in axial direction in relation to the pin by means of the adjustment means, the pin retaining ring serves as a stop for the axial displacement of the actuating means and if required can be further supplemented by a flexible element for example in the form of a helical spring applying a return force in axial direction when acting on the actuating means.

The particular embodiment of claim 5 offers the advantage that even reduced switching angles can be permanently and precisely adjusted. By its engagement on the peripheral surface the switching means is displaced in the direction of contact during rotation of the pin and when it passes over the segment. Alternatively to and/or in supplement to the notch or groove found thereon, the peripheral surface can also incorporate one or more cams in its design. Alternatively to the use of a cam plate, a lever having one or more arms can be used, with the lever arrangement cooperating with the switching means.

The particular embodiment of claim 6 offers the advantage that the adjustment means do not come into contact with the switching means and thus that complete revolutions of the pin are possible, because the adjustment means are arranged to be axially displaced relative to the peripheral area and particularly relative to the contacting of the switching means on the peripheral surface of the cam plate.

The particular embodiment of claim 7 provides the advantage that the adjustment range for the actuating means can be predetermined simply by providing the dimensions of the longer edge of the rectangle of simple construction and of ample size. In the area of the actuating means the pin preferably has a smaller diameter than the outside of the device. In the area of the actuating means, the pin can be provided with one or with two diametrically opposite parallel surface areas, of which the spacing corresponds to the length of the shorter edge of the rectangle, whereupon a still more precise guiding of the actuating means in its displacement in radial direction in relation to the pin can be guaranteed.

The particular embodiment according to claim 8 provides the advantage that with such a constructively simple solution a reliable switching is guaranteed preferably by axial displacement of the tappet. A spatial separation of the mechanical and electrical components is thus attained.

The particular embodiment according to claim 9 offers the advantage that an adjustment or readjustment of the switching point is possible even following the assembly of the device or for example within the framework of maintenance and repairs.

The particular embodiment as in claim 10 offers the advantage that this embodiment makes possible a simple mechanical coupling for example to a protective arrangement of a machine tool, which protective arrangement is to be monitored. The device can be fastened for example to a housing of the protective arrangement or to the machine tool itself, whereas the pin is connected with the hinge rod or the hinge bolt of a protective gate or protective cover or hood articulated on the housing, for example by means of a connecting sleeve.

Other advantages, features and particular provisions of the invention are to be learned from the following description, in which one exemplary embodiment is described in detail with reference to the drawing. Herein it is possible to find the features described both in the claims and in the description as of inventive concept in turn either individually in and of themselves or in any desired combination.

Figure 2:
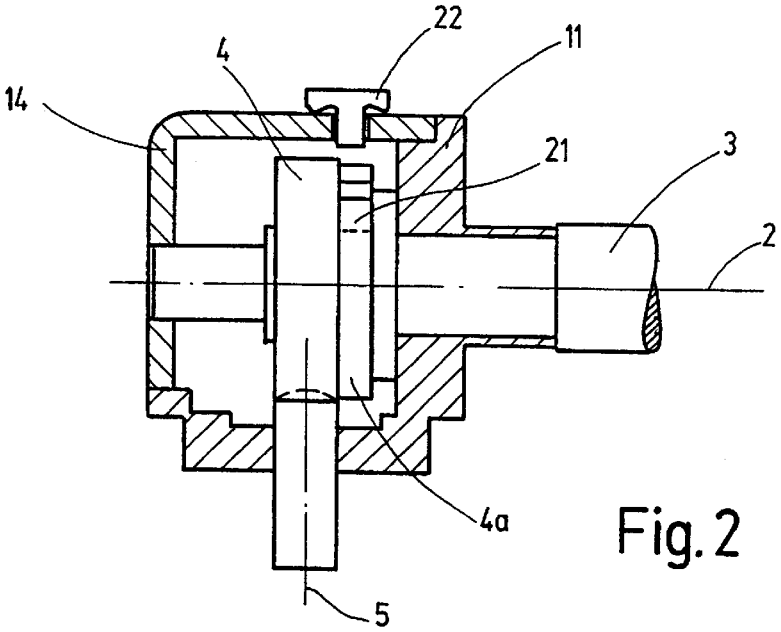
Figure 3A:
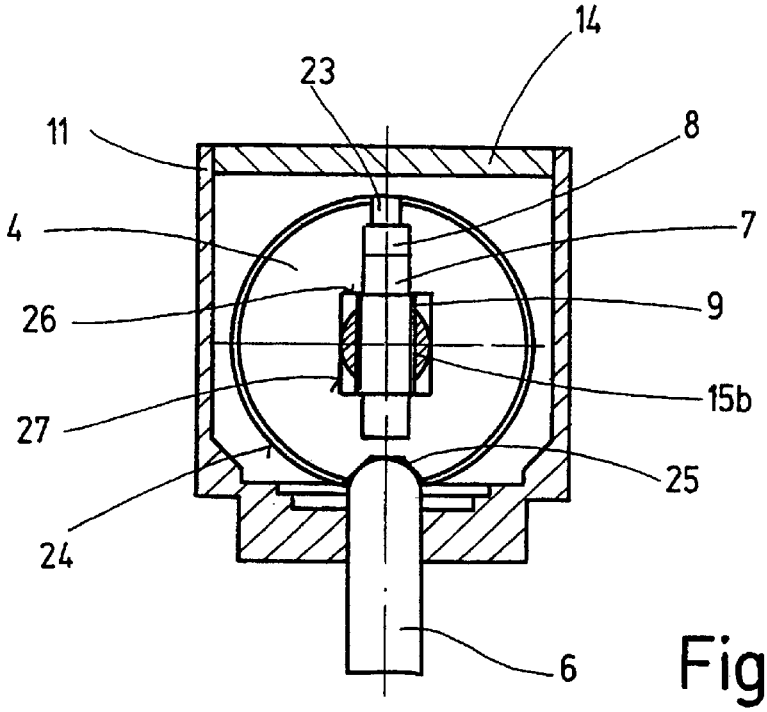
Figure 3B:
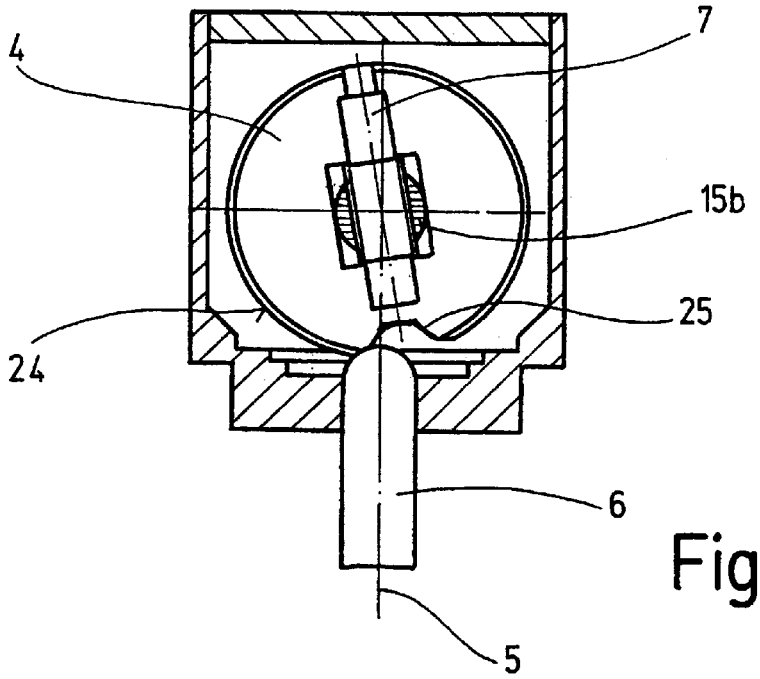

FIG. 1 shows the transverse section through a device according to the invention, FIG. 2 shows a modified embodiment of the switching head of FIG. 1, FIG. 3A shows a section along III—III of the device of FIG. 1, and FIG. 3B shows the arrangement of FIG. 3A with a displacement of the pin of approximately 10 degrees.

FIG. 1 shows the transverse section through a device according to the invention in the form of a hinge switch 1 having a pin 3 which can be rotated around a pin axis 2 and connected from outside the device with a hinge rod or a hinge bolt, and an actuating means in the form of a cam plate 4 arranged connected thereto, which cooperates with a switching means in the form of a switch tappet 6 which can be displaced along a tappet axis 5 which switches the electric connection when a certain switching point has been exceeded.

Cam plate 4 can be radially displaced in relation to pin 3 by means of the headless screw 7 serving as adjustment means in such a manner that the switching point can be adjusted to be set on any predeterminable angle position of pin 3. Headless screw 7 is arranged to be stationary relative to cam plate 4, mounted by means of its journal-like end segments, of which one incorporates a slot 8 for the engagement of a tool, particularly a screwdriver, particularly being inserted into a receiving area of cam plate 4 in form-locking juncture with the end segments. The receiving shape can be adapted to the cylindrical shape of headless screw 7 in such a manner that this headless screw catches and holds in the shape of the receiving mounting. Headless screw 7 has an exterior threading 9 between its two end segments, with which it can be screwed into a threaded bore found in pin 3.

On its first axial end cam plate 4 has a circular or partially circular-shaped bracket 10, with which it engages on a first housing part 11 of the head housing 11, 14 holding cam plate 4. At the opposite axial end cam plate 4 engages on a pin retaining ring 13 inserted into an annular groove 12 which is arranged encircling pin 3.

With the cooperation between the bracket 10 which is preferably configured as one integral piece with cam plate 4 and the first housing part 11 of head housing 11, 14, as well as cam plate 4 with pin retaining ring 13, cam plate 4 of the exemplary embodiment which is represented is fixed in its axial position in relation to pin 3.

In the area of head housing 11, 14, pin 3 has two segments 15*a*, 15*b*, reduced in relation to its diameter and one recessed in relation to the other, whereby end segment 15*b* of pin 3 projects into an opening of a second housing part 14 of head housing 11, 14 which is removable or can be folded back from the first housing part 11, so that end segment 15*b* and with that pin 3 can be rotated from outside of hinge switch 1 by means of a tool, for example a screwdriver or a hexagonal socket wrench, in order to test the electric switch function and/or to adjust the switching point dependent upon the angle of rotation. First housing part 11 at the point where pin 3 projects out therefrom preferably includes an integral bracket 16, which receives the first segment 15*a* of pin 3 which is recessed in the diameter and forms a stop for pin 3 in the direction of head housing 11, 14.

Head housing 11, 14 can be fastened securely to a switch housing 17 surrounding switch tappet 6 preferably with use of a not shown packing or gasket means to avoid the penetration therein of contaminants and/or moisture. Switch tappet 6 supports all four electric contacts 18*a*, 18*b*, 18*c*, 18*d* on a contact support plate 18, and these contacts, during a displacement of switch tappet 6 parallel to tappet axis 5, cooperate in turn with contacts 19*a*, 19*b*, 19*c*, 19*d*, arranged opposite from and stationary relative to switch housing 17, and connect the electric connection, particularly in order to open the electric connections between contact elements 18*a* and 19*a* or 18*b* and 19*b* and to close the electric connections between contact elements 18*c* and 19*c* or 18*d* and 19*d*. Switch tappet 6 is held by means of some sort of accumulator or an elastic element, in the present example by a helical spring 20 engaging on the switch housing 17, the helical spring being prebiased in the direction toward cam plate 4. Head housing 11, 14 can be retained securely in various angle positions on switch housing 17 with reference to tappet axis 5.

FIG. 2 shows a modification of the switch head of FIG. 1, wherein cam plate 4 represented in the drawing, in a segment 4*a* which is radially recessed and has a smaller diameter, has two assembly grooves 21 cut secant-like and symmetrically opposite in relation to the plane defined by pin axis 2 and tappet axis 5 in this particular embodiment, in which groove engages an assembly tool, particularly during the assembly of the switch head. Alternatively to the two assembly grooves 21, either one single similar groove or a plurality of corresponding bores could also be provided. As a result of this arrangement, second housing part 14 of head housing 11, 14 has an opening which can be closed by means of a preferably elastic tightly fitting covering 22, the opening arranged for passage of a tool for actuating headless screw 7 and together with that for the adjustment of cam plate 4 or of the switching point.

FIG. 3A shows a section along line III—III of the device of FIG. 1. Slot 8 of headless screw 7 is accessible from outside cam plate 4 through the cutout 23 and likewise is accessible from outside head housing 11, 14, and essentially only in the area of its segment cooperating with end segment 15*b* of pin 3 has the aforementioned exterior threading 9.

Headless screw 7 can be inserted form-locking in axial alignment into a recess in cam plate 4 corresponding especially with its end segments, whereupon the cam plate is mounted securely, in relation to the direction of rotation of pin 3 thereon. Cam plate 4 has a rectangular opening preferably in the center, of which the length of the shorter side 26 corresponds to the diameter of end segment 15*b* of pin 3 and the length of the longer side 27 defines the adjustment range for cam plate 4. Peripheral surface 24 of cam plate 4 has a notch-like cutout 25 aligned facing switch tappet 6 in the starting position which is shown, the cutout having two sides inclined to a bottom surface forming a right angle with tappet axis 5, in which cutout engages this rounded and preferably hemispherical end segment, because it has been pre-biased in the direction toward cam plate 4.

FIG. 3B shows the arrangement of FIG. 3A with a displacement of pin 3 of approximately 10 degrees in counterclockwise direction. Because of the form-locking connection of headless screw 7 screwed together with pin 3 or its end segment 15*b* and cam plate 4 this too is rotated around the corresponding angle magnitude, and switch tappet 6 is moved counter to its spring pre-biasing away from cam plate 4 along tappet axis 5, and thus switches the electric connection. While the degree of lift is determined primarily by the shape and dimensions of cutout 25, the switching point with any given cutout 25 can be determined precisely and permanently by the adjustment of the position of cam plate 4 in relation to pin 3 by means of headless screw 7. Of course it is also possible that a plurality of cutouts 25 could be distributed in uniform or nonuniform spacing over the peripheral surface area 24. Likewise it would be possible for cutouts 25 and cams to be distributed alternatively in any desired arrangement and combination as well as having different depths or heights of the members relative to peripheral surface area 24.

What is claimed is:

1. A device for switching an electrical connection, comprising a pin actuatable from outside the device;

actuating means, arranged on said pin and coupled to switching means, for cooperating with said switching means to switch an electrical connection when a selected switching point is exceeded; and adjusting means for displacing said actuating means in radial and axial directions relative to said pin to set the switching point at different predetermined angles of said pin.

2. A device according to claim 1 wherein said adjustment means comprises a headless screw mounted axially stationary relative to said actuating means, and rotatable about a longitudinal axis thereof for threaded movement relative to a threaded bore in said pin.

3. A device according to claim 2 wherein said headless screw is received in a mounting area in said actuating means; and said threaded bore extends radially into said pin.

4. A device according to claim 1 wherein said actuating means is affixed by at least one pin retaining ring in an axial position on said ring.

5. A device according to claim 1 wherein said actuating means comprises a cam plate having a peripheral surface with a generally circular shape and with a segment deviating from said circular shape, said peripheral surface cooperating with the switch means.

6. A device according to claim 5 wherein said segment is a notch-like cutout.

7. A device according to claim 5 wherein said adjustment means is axially offset opposite said peripheral surface of said cam plate.

8. A device according to claim 5 wherein said cam plate comprises a rectangular opening through which said pin passes, said rectangular opening having a shorter side corresponding in length to a transverse diameter of said pin adjacent said cam plate and a longer side corresponding in length to an adjustment range for said actuating means.

9. A device according to claim 8 wherein said rectangular opening is in a center of said cam plate.

10. A device according to claim 8 wherein a recessed end segment of said pin passes through said rectangular opening.

11. A device according to claim 1 wherein said switching means comprises a switch tappet supporting at least one switch contact.

12. A device according to claim 11 wherein said at least one switch contact is on a segment of said switch tappet spaced from said actuating means.

13. A device according to claim 1 wherein said adjustment means is accessible from outside of the device.

14. A device according to claim 1 wherein said pin is coupled outside of the device to a hinge rod.

15. A device according to claim 1 wherein said pin is coupled outside of the device to a hinge bolt.

16. A device according to claim 1 wherein said switching means is a hinge switch.

* * * * *

UNITED STATES PATENT AND TRADEMARK OFFICE

CERTIFICATE OF CORRECTION

PATENT NO. : 6,548,774 B1
DATED : April 15, 2003
INVENTOR(S) : Erik Bachle

It is certified that error appears in the above-identified patent and that said Letters Patent is hereby corrected as shown below:

Title page,
Item [73], Assignee, should read as follows:

-- Euchner GmbH & Co. --

Signed and Sealed this

Twenty-second Day of July, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,548,774 B1
DATED : April 15, 2003
INVENTOR(S) : Erik Bachle

It is certified that error appears in the above-identified patent and that said Letters Patent is hereby corrected as shown below:

Title page,
Item [75], Inventor, "Erik Bachle" should read -- Erik Bächle --, and Column 5,
Line 44, "radial and axial" should read -- radial and/or axial --.

Signed and Sealed this

Twenty-fourth Day of May, 2005

JON W. DUDAS
*Director of the United States Patent and Trademark Office*